US011073773B1

(12) United States Patent
Watanabe et al.

(10) Patent No.: US 11,073,773 B1
(45) Date of Patent: Jul. 27, 2021

(54) IMAGE FORMING APPARATUS AND CONTROL METHOD THEREOF

(71) Applicant: TOSHIBA TEC KABUSHIKI KAISHA, Tokyo (JP)

(72) Inventors: Mitsutoshi Watanabe, Tagata Shizuoka (JP); Hirotaka Fukuyama, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/032,014

(22) Filed: Sep. 25, 2020

(51) Int. Cl.
*G03G 15/08* (2006.01)

(52) U.S. Cl.
CPC ..... *G03G 15/0808* (2013.01); *G03G 15/087* (2013.01); *G03G 15/0889* (2013.01); *G03G 15/0891* (2013.01); *G03G 2215/00772* (2013.01); *G03G 2215/0836* (2013.01)

(58) Field of Classification Search
CPC ..... G03G 15/0808; G03G 15/087; G03G 15/0889; G03G 15/0891; G03G 2215/00772; G03G 2215/0836
See application file for complete search history.

(56) References Cited

U.S. PATENT DOCUMENTS

2009/0269088 A1* 10/2009 Mizuta ..... G03G 15/0856 399/30
2010/0209127 A1* 8/2010 Hokkyoh ..... G03G 15/09 399/53
2011/0293333 A1* 12/2011 Shima ..... G03G 15/0856 399/258

FOREIGN PATENT DOCUMENTS

JP 2007-133074 5/2007

* cited by examiner

*Primary Examiner* — Joseph S Wong
(74) *Attorney, Agent, or Firm* — Amin, Turocy & Watson, LLP

(57) ABSTRACT

According to one embodiment, the image forming apparatus includes a developing device and a control unit. The developing device includes a rotator for rotating to cause a developer contained in a container to flow, and performs development using the developer. The control unit has a first control for rotating the rotator in a first direction during development. The control unit has a second control that rotates the rotator in a second direction opposite to the first direction at a predetermined timing when development is not performed. When the second control is performed a plurality of times during a predetermined period, the control unit gradually reduces an interval at which the second control is performed.

20 Claims, 6 Drawing Sheets

FIG. 4

| | | NUMBER OF EXECUTION | | |
|---|---|---|---|---|
| | | 0 | 1 | 2~ |
| TEMPERATURE ZONE | TZA | SAA | SAB | SAC |
| | TZB | SBA | SBB | SBC |
| | TZC | SCA | SCB | SCC |

IMAGE FORMING APPARATUS AND CONTROL METHOD THEREOF

FIELD

Embodiments described herein relate generally to an image forming apparatus and a control method thereof.

BACKGROUND

An electrophotographic image forming apparatus includes a developing device that develops an electrostatic latent image with a developer. The developing device includes a rotator such as a developing sleeve for conveying a part of the developer stored in the container for development.

The rotator rotates in a fixed direction while the development is performed. Such rotation of the rotator causes the developer stored in the container to flow in a fixed direction, which may cause the caking of the developer or sticking of the developer to constituent members of the developing device. Further, caking or sticking may cause deterioration of developing performance and image quality may be deteriorated.

Therefore, there is known a technique for preventing caking or sticking by rotating the rotator in the reverse direction at a fixed cycle when image formation is not being performed.

However, since the image cannot be formed during the reverse rotation of the rotator, if the frequency of the reverse rotation is increased, the ratio of the image non-formable period to the image formable period increases and thus, the productivity is decreased. Therefore, if the frequency of the reverse rotation is reduced, there is a concern that the occurrence of caking or sticking cannot be prevented.

Under these circumstances, it has been desired to prevent the occurrence of caking or sticking while suppressing a decrease in productivity.

DESCRIPTION OF THE DRAWINGS

FIG. 4 is a diagram showing an example of the threshold table shown in FIG. 3;

DETAILED DESCRIPTION

In general, according to one embodiment, the image forming apparatus includes a developing device and a control unit. The developing device includes a rotator for rotating to cause the developer contained in the container to flow, and performs development using the developer. The control unit has a first control for rotating the rotator in a first direction during development. The control unit has a second control for rotating the rotator in a second direction opposite to the first direction at a predetermined timing when development is not performed. When the second control is performed a plurality of times within a predetermined period, the control unit gradually reduces the interval at which the second control is performed.

An example of an embodiment will be described below with reference to the drawings. In this embodiment, a multi-function peripheral (MFP) equipped with an image forming apparatus as a printer will be described as an example.

Figure 1:
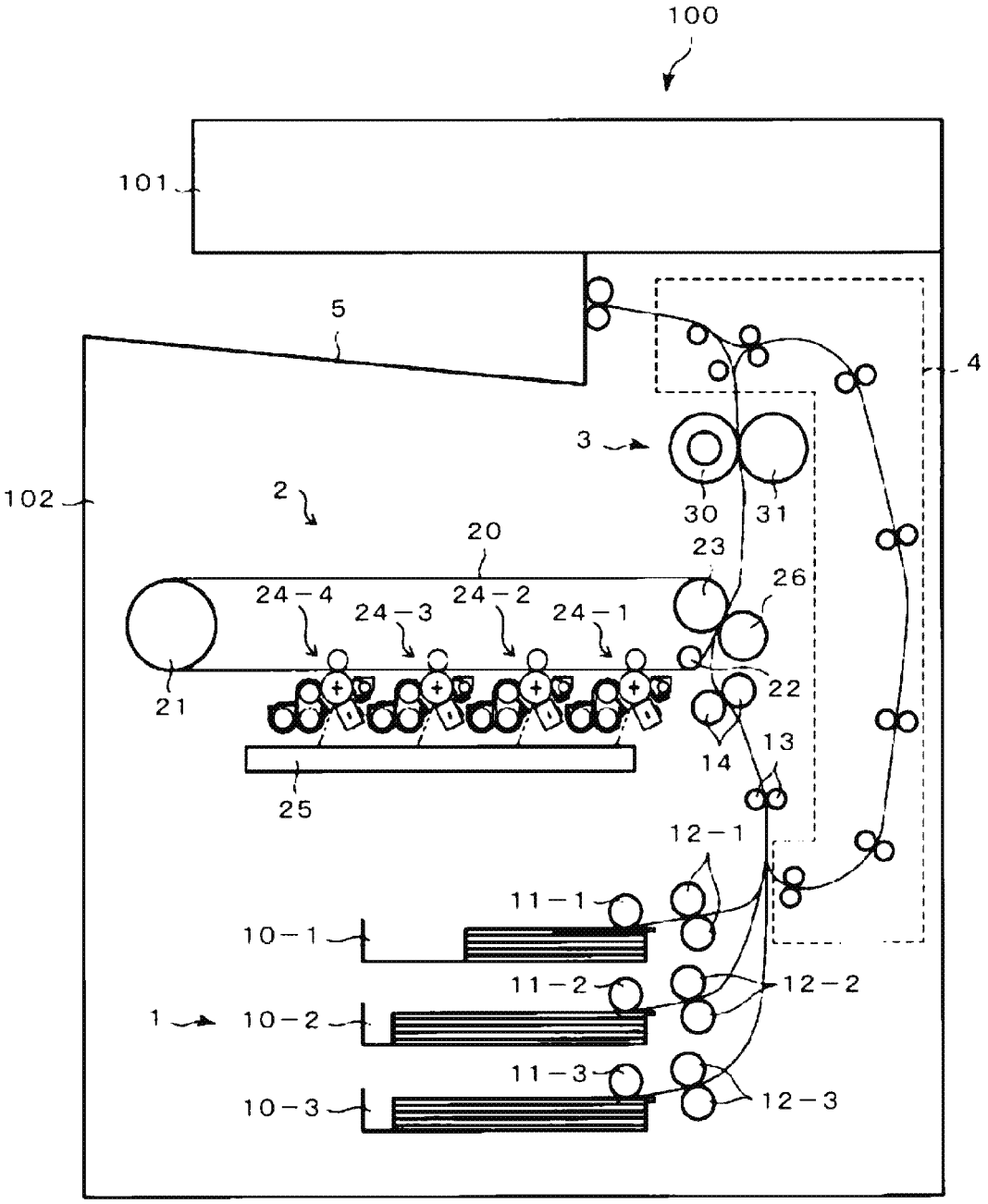
FIG. 1 is a diagram schematically showing a mechanical configuration of an MFP according to an embodiment.

FIG. 1 is a diagram schematically showing a mechanical configuration of an MFP 100 according to the present embodiment.

As shown in FIG. 1, the MFP 100 includes a scanner 101 and a printer 102.

The scanner 101 reads an image of a document and generates image data corresponding to the image. The scanner 101 uses an image sensor such as a CCD line sensor to generate image data according to a reflected light image from the reading surface of the document. The scanner 101 scans a document placed on a document table with an image sensor that moves along the document. Alternatively, the scanner 101 scans a document conveyed by an auto document feeder (ADF) with a fixed image sensor.

The printer 102 forms an image on an image forming medium by the electrophotographic method. The medium is typically a print sheet such as cut paper. Therefore, in the following description, it is assumed that a print sheet is used as the medium. However, as the medium, a sheet material made of paper other than the cut paper may be used or a sheet material made of a material other than paper such as resin may be used. The printer 102 has a color printing function of printing a color image on a print sheet and a monochrome printing function of printing a monochrome image on the print sheet. The printer 102 forms a color image by superposing element images respectively using, for example, three colors of developers of yellow, cyan and magenta, or four colors including black added thereto. In addition, the printer 102 forms a monochrome image using, for example, a black developer. However, the printer 102 may have only one of the color printing function and the monochrome printing function.

In the configuration example shown in FIG. 1, the printer 102 includes a sheet feeding unit 1, a print engine 2, a fixing unit 3, an automatic double-sided unit (ADU) 4, and a paper discharge tray 5.

The sheet feeding unit 1 includes sheet feed cassettes 10-1, 10-2, and 10-3, pickup rollers 11-1, 11-2, and 11-3, conveying rollers 12-1, 12-2, and 12-3, a conveying roller 13, and a registration roller 14.

The sheet feed cassettes 10-1, 10-2, and 10-3 store print sheets in a stacked state. The print sheet stored in each of the sheet feed cassettes 10-1, 10-2, and 10-3 may be another kind of print sheet having a different size and material, or the same kind of print sheet. The sheet feeding unit 1 may also include a manual feed tray.

The pickup rollers 11-1, 11-2, and 11-3 pick up the print sheets one by one from the respective sheet feed cassettes 10-1, 10-2, and 10-3. The pickup rollers 11-1, 11-2, and 11-3 convey the picked-up print sheet to the conveying rollers 12-1, 12-2, and 12-3.

The conveying rollers 12-1, 12-2, and 12-3 convey the print sheet conveyed from the pickup rollers 11-1, 11-2, and 11-3 to the conveying roller 13 through a conveyance path formed by a guide member (not shown) or the like.

The conveying roller 13 further conveys the print sheet conveyed from any of the conveying rollers 12-1, 12-2, and 12-3 to the registration roller 14.

The registration roller 14 corrects the inclination of the print sheet. The registration roller 14 adjusts the timing of conveying the print sheet to the print engine 2.

The sheet feed cassette, the pickup roller, and the conveying roller are not limited to three sets and any number of sets may be provided. Further, if the manual feed tray is provided, it is not necessary to provide a set of the sheet feed cassette and a pair of pickup roller and conveying roller which are paired with the sheet feed cassette.

The print engine 2 includes a belt 20, support rollers 21, 22, and 23, image forming units 24-1, 24-2, 24-3, and 24-4, an exposure unit 25, and a transfer roller 26.

The belt 20 has an endless shape and is supported by the support rollers 21, 22, and 23 so as to maintain the state shown in FIG. 1. The belt 20 rotates counterclockwise in FIG. 1 as the support roller 21 rotates. The belt 20 temporarily carries an image to be formed on the print sheet.

The image forming units 24-1, 24-2, 24-3, and 24-4 each include a photoreceptor drum, a charger, a developing device, a transfer roller, and a cleaner, and has a well-known structure for performing image formation by the electrophotographic method in cooperation with the exposure unit 25. The image forming units 24-1, 24-2, 24-3, and 24-4 are arranged along the belt 20 in a state where the axial directions of the respective photoreceptor drums are parallel to each other. The image forming units 24-1, 24-2, 24-3, and 24-4 have the same structure and operation with a difference only in the colors of the using developers used. The image forming unit 24-1 forms an element image using, for example, a black developer. The image forming unit 24-2 forms an element image using, for example, a magenta developer. The image forming unit 24-3 forms an element image using, for example, a cyan developer. The image forming unit 24-4 forms an element image using, for example, a yellow developer. The image forming units 24-1, 24-2, 24-3, and 24-4 make the element images of respective colors overlap each other on the belt 20. As a result, the image forming units 24-1, 24-2, 24-3, and 24-4 form a color image in which each element image of each color is superimposed on the belt at the time when the image forming unit 24-1 passed. It is also possible to form a monochrome image using only black by operating only the image forming unit 24-1.

The exposure unit 25 includes four built-in exposure units respectively associated with the image forming units 24-1, 24-2, 24-3, and 24-4. The exposure unit 25 exposes the photoreceptor drums of the image forming units 24-1, 24-2, 24-3, and 24-4 according to image data representing element images of respective colors. A laser scanner, a light emitting diode (LED) head, or the like is used as the exposure device.

The transfer roller 26 is arranged in parallel with the support roller 23 and sandwiches the belt 20 between the transfer roller 26 and the support roller 23. The transfer roller 26 sandwiches the print sheet conveyed from the registration roller 14 between the transfer roller 26 and the belt 20. Then, the transfer roller 26 transfers the image formed on the belt 20 onto a print sheet by using the electrostatic force.

Thus, the print engine 2 forms an image on the print sheet conveyed by the registration rollers 14 by the electrophotographic method.

The fixing unit 3 includes a fixing roller 30 and a pressure roller 31.

The fixing roller 30 houses a heater inside a hollow roller made of, for example, heat-resistant resin. The heater is, for example, an induction heating (IH) heater but any other type of heater can be used as appropriate. The fixing roller 30 fixes the developer on the print sheet by melting the developer attached to the print sheet conveyed from the print engine 2.

The pressure roller 31 is provided in parallel with the fixing roller 30 and pressed against the fixing roller 30. The pressure roller 31 sandwiches the print sheet conveyed from the print engine 2 between the pressure roller 31 and the fixing roller 30 and presses the print sheet against the fixing roller 30.

An ADU 4 includes a plurality of rollers and selectively performs the following two operations. In a first operation, the print sheet that passed through the fixing unit 3 is directly conveyed to the sheet discharge tray 5. The first operation is performed when single-sided printing or double-sided printing is completed. In a second operation, the print sheet that passed through the fixing unit 3 is once conveyed to the sheet discharge tray 5 side and then switched back to be conveyed to the print engine 2. The second operation is performed when the image formation on only one side in double-sided printing is completed.

The sheet discharge tray 5 receives the print sheet discharged with an image formed thereon.

Figure 2:
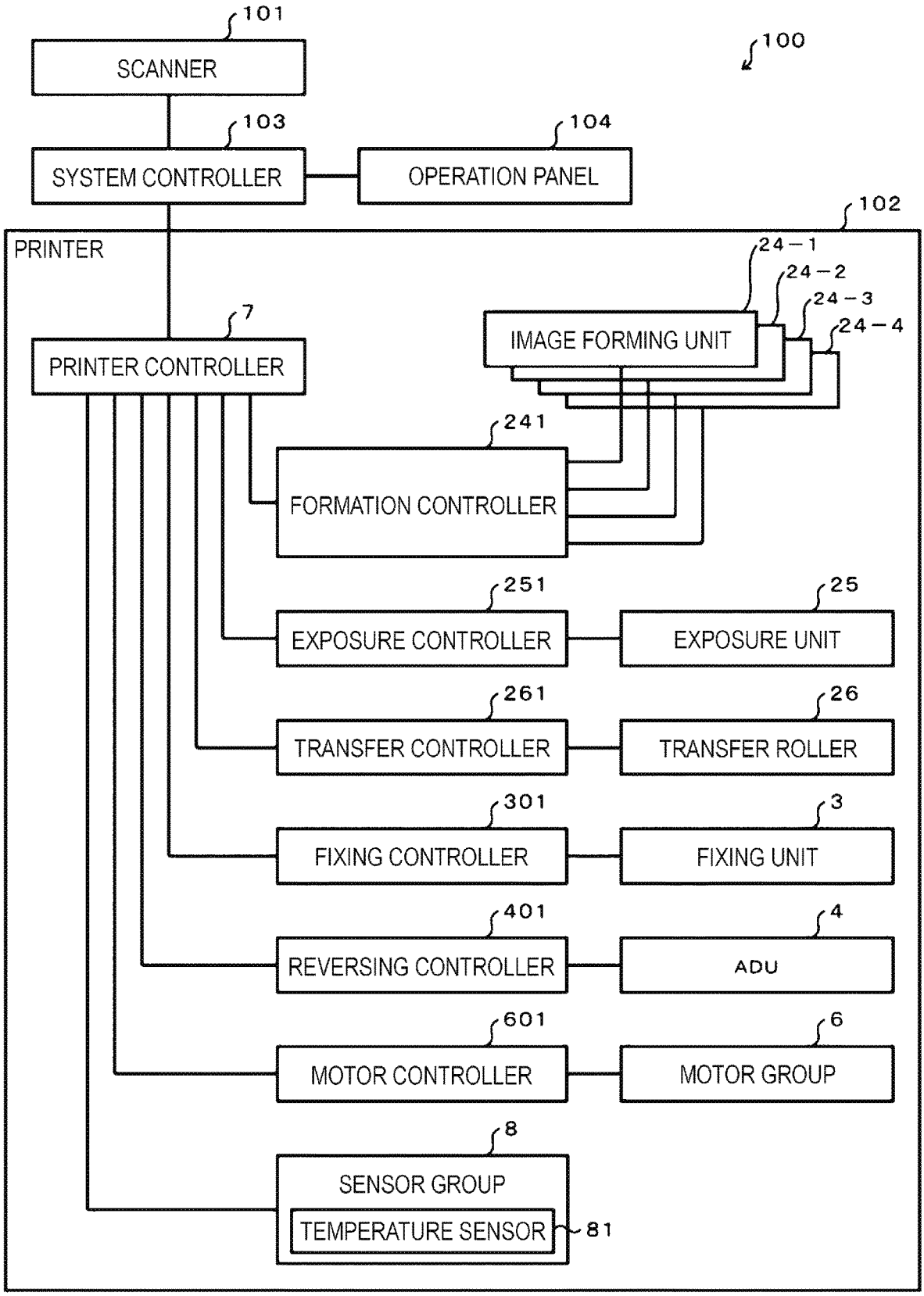
FIG. 2 is a block diagram schematically showing a configuration related to the control of the MFP shown in FIG. 1.

FIG. 2 is a block diagram schematically showing a configuration related to the control of the MFP 100. In FIG. 2, the same elements as those shown in FIG. 1 are denoted by the same reference numerals and the detailed descriptions thereof will be omitted.

The MFP 100 includes a system controller 103 and an operation panel 104 in addition to the scanner 101 and the printer 102.

The system controller 103 centrally controls each unit included in the MFP 100 in order to realize the intended operation of the MFP 100. The intended operation of the MFP 100 is, for example, an operation for realizing various functions realized by an existing MFP.

The operation panel 104 includes an input device and a display device. The operation panel 104 inputs an instruction from an operator using an input device. The operation panel 104 uses a display device to display various kinds of information to be notified to the operator. A touch panel, for example, can be used as the operation panel 104.

The above-mentioned fixing unit 3, ADU 4, image forming units 24-1, 24-2, 24-3, and 24-4, exposure unit 25, and transfer roller 26 included in the printer 102 are elements to be controlled. In addition to these, the printer 102 includes a motor group 6 as an element to be controlled. The motor group 6 includes a plurality of motors for rotating the pickup rollers 11-1, 11-2, and 11-3, the conveying rollers 12-1, 12-2, and 12-3, the conveying roller 13, the registration roller 14, the support roller 21, the transfer roller 26, the fixing roller 30, and the rollers included in the ADU 4.

The printer 102 further includes a printer controller 7, a sensor group 8, a fixing controller 301, a reversing controller 401, a motor controller 601, a formation controller 241, an exposure controller 251, and a transfer controller 261.

The fixing controller 301, the reversing controller 401, the motor controller 601, the formation controller 241, the exposure controller 251, and the transfer controller 261 all operate under the control of the printer controller 7 and control the operations of the ADU 4, the motor group 6, and the image forming units 24-1 to 24-4, the exposure unit 25 and the transfer roller 26, respectively.

Under the control of the system controller 103, the printer controller 7 centrally controls each unit included in the printer 102 in order to realize the intended operation of the printer 102.

The sensor group 8 includes various sensors for monitoring the operating state of the device. One of the sensors included in the sensor group 8 is a temperature sensor 81. The temperature sensor 81 measures the temperature inside the MFP 100.

Figure 3:
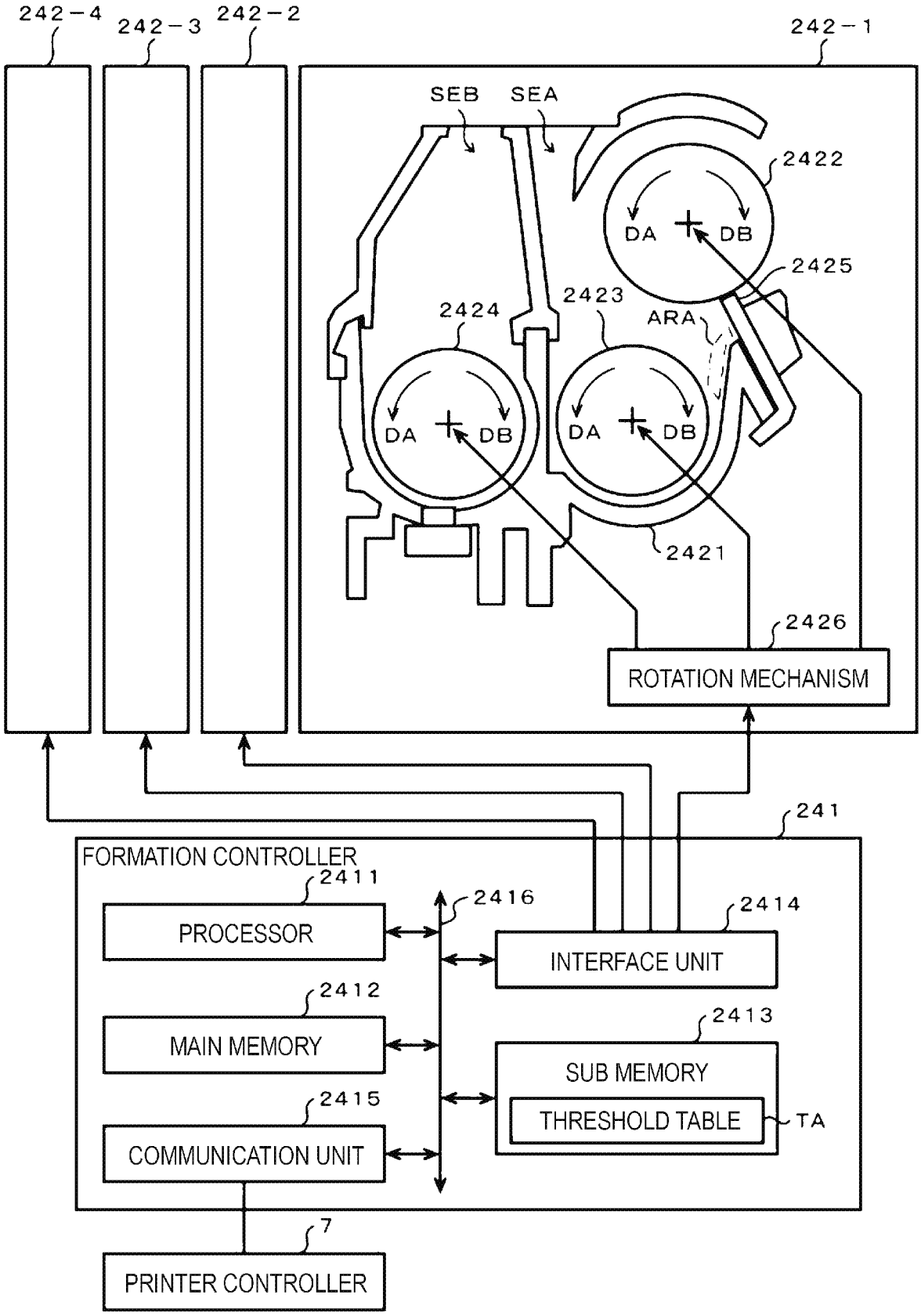
FIG. 3 is a diagram showing a circuit configuration of a main part of the formation controller shown in FIG. 2 and a configuration of a main part of a developing device included in the image forming unit shown in FIG. 2.

FIG. 3 is a diagram showing a circuit configuration of a main part of the formation controller 241 and a configuration of main parts of the developing devices included in the image forming units 24-1 to 24-4.

Since the image forming units 24-1 to 24-4 have the same configuration, FIG. 3 shows only the configuration of the developing device 242-1 included in the image forming unit 24-1. The illustrations and descriptions of the configurations of the developing devices 242-2 to 242-4 included in the image forming units 24-2 to 24-4 are omitted.

The developing device 242-1 includes a housing 2421, a developing sleeve 2422, mixers 2423 and 2424, a doctor blade 2425, and a rotation mechanism 2426.

The housing 2421 forms a space for containing the developer inside. That is, the housing 2421 functions as a container for containing the developer. The space inside the housing 2421 is partitioned into a section SEA and a section SEB. The section SEA and the section SEB are connected via an opening not shown in FIG. 3.

The developing sleeve 2422 has a cylindrical shape and is rotatably supported by the housing 2421 in a posture in which the axial direction is oriented in the depth direction in FIG. 3, and a part of which is located in the section SEA. That is, the developing sleeve 2422 is one of the rotators. The developing sleeve 2422 contains magnets arranged so that magnetic poles are alternately formed along the circumferential surface in the circumferential direction.

The mixers 2423 and 2424 are configured by attaching a stirrer to the rotary shaft. The mixer 2423 is rotatably supported by the housing 2421 in a state of being positioned in the vicinity of the bottom of the section SEA in a posture in which the axial direction of the rotary shaft is oriented in the depth direction in FIG. 3. The mixer 2424 is rotatably supported by the housing 2421 in a state of being positioned in the vicinity of the bottom of the section SEB in a posture in which the axial direction of the rotary shaft is oriented in the depth direction in FIG. 3. The mixers 2423 and 2424 are rotated about the rotary shaft so that the stirrer rotates within a region represented by a circle in FIG. 3. That is, each of the mixers 2423 and 2424 is one of the rotators.

The doctor blade 2425 has a plate-like shape and is attached to the housing 2421 in a state where its tip is close to the circumferential surface of the developing sleeve 2422. The doctor blade 2425 limits the amount of developer that moves from the section SEA to the outside of the housing 2421 as the developing sleeve 2422 rotates.

The rotation mechanism 2426 includes, for example, a motor and gears and rotates the developing sleeve 2422 and the mixers 2423 and 2424, respectively. The rotation mechanism 2426 can rotate the developing sleeve 2422 and the mixers 2423 and 2424 in both the directions DA and DB.

The formation controller 241 includes a processor 2411, a main memory 2412, a sub memory 2413, an interface unit 2414, a communication unit 2415, and a transmission path 2416. The processor 2411, the main memory 2412, the sub memory 2413, the interface unit 2414, and the communication unit 2415 are communicable via the transmission path 2416. The processor 2411, the main memory 2412, and the sub memory 2413 are connected by the transmission path 2416, thereby configuring a computer for controlling the image forming units 24-1 to 24-4.

The processor 2411 corresponds to the central part of the computer. The processor 2411 executes information processing for controlling the image forming units 24-1 to 24-4 according to an information processing program. The processor 2411 is, for example, a central processing unit (CPU).

The main memory 2412 corresponds to the main storage part of the computer. The main memory 2412 temporarily stores the above information processing program read from the sub memory 2413. The main memory 2412 stores data necessary for the processor 2411 to execute information processing. The main memory 2412 is used as a work area in which data is appropriately rewritten by the processor 2411. The main memory 2412 is, for example, a random access memory (RAM).

The sub memory 2413 corresponds to the auxiliary storage part of the computer. The sub memory 2413 is, for example, an electric erasable programmable read-only memory (EEPROM). The sub memory 2413 stores the above information processing program. A part of the storage area of the sub memory 2413 is used to store the threshold table TA.

The rotation mechanism 2426 provided in each of the developing devices 242-1 to 242-4 is connected to the interface unit 2414. The interface unit 2414 outputs a control signal for controlling the rotation mechanism. 2426 under the control of the processor 2411.

The communication unit 2415 executes communication processing for exchanging various data with the printer controller 7.

The transmission path 2416 includes an address bus, a data bus, a control signal line, and the like, and transmits data and control signals exchanged between the connected parts.

FIG. 4 is a diagram showing an example of a threshold table TA.

The threshold table TA is a data table in which thresholds for determining whether or not to execute a reverse rotation operation to be described later are described. The threshold represents the number of sheets to be formed until the reverse rotation operation starts in the continuous forming period. The continuous forming period refers to a period in which the situation continues in which the next development needs to be started during the development of one sheet. The execution period of a job for forming an image on a plurality of print sheets corresponds to the continuous forming period. Further, in the situation where another job is reserved during the execution of the job, the execution period of the plurality of jobs corresponds to the continuous forming period.

In the present embodiment, a threshold is set for each of the three temperature zones TZA, TZB, and TZC in association with cases where the number of executions of the reverse rotation operation during the continuous forming period is 0, 1, and 2 or more. The temperatures included in the temperature zone have a relationship of TZA<TZB<TZC.

Each threshold has a relationship of SAA>SAB>SAC, SBA>SBB>SBC, and SCA>SCB>SCC. That is, the threshold for the same temperature zone is a smaller value as the number of executions of the reverse rotation operation is larger.

Each threshold has a relationship of SAA>SBA>SCA, SAB>SBB>SCB, and SAC>SBC>SCC. That is, the threshold for the same number of executions is smaller as the temperature is higher.

Next, the operation of the MFP 100 configured as above will be described. In the following, operations different from those of another existing MFP will be mainly described and the descriptions of the other operations will be omitted.

First, the developing operation of the developing device 242-1 will be described although the developing operation is similar to that of another existing MFP. Although the description is omitted, the operations of the developing devices 242-2 to 242-4 are the same as that of the developing device 242-1.

During image formation, the processor 2411 causes the rotation mechanism 2426 to rotate the developing sleeve 2422 and the mixers 2423 and 2424 in a direction DA. That is, the processor 2411 rotates the developing sleeve 2422 and the mixer 2423, which are examples of the rotator, in the direction DA as an example of a first direction. Thus, the computer having the processor 2411 as a central part performs the first control by the processor 2411 executing the information processing based on the information processing program and functions as the control unit. The continuous forming period corresponds to a period during which the first control is continuously executed.

The developer contained in the section SEA is in contact with the circumferential surface of the developing sleeve 2422. The developer is, for example, a mixture of toner as a coloring material and carrier which is a magnetic material. Therefore, the developer adheres to the circumferential surface of the developing sleeve 2422. The developer attached to the circumferential surface of the developing sleeve 2422 is conveyed to the outside of the housing 2421 as the developing sleeve 2422 rotates. At this time, the thickness of the developer flowing out of the housing 2421 is adjusted by the doctor blade 2425. The developer conveyed to the outside of the housing 2421 is partially attached to the surface of a photoreceptor (not shown) which is arranged outside the housing 2421 to face the developing sleeve 2422, according to the electrostatic latent image formed thereon. As a result, the electrostatic latent image is made visible by the developer. The developer that was conveyed to the outside of the housing 2421 but did not adhere to the photoreceptor is returned as it is into the section SEA as the developing sleeve 2422 rotates.

The developer in the section SEA is agitated by the mixer 2423. The developer in the section SEA is supplied by the mixer 2423 to the vicinity of the circumferential surface of the developing sleeve 2422. The developer in the section SEB is agitated by the mixer 2424. Further, the developer in the section SEB is sent by the mixer 2424 to the section SEA through an opening not shown in FIG. 3.

In such a state, a part of the developer flowing with the rotation of the developing sleeve 2422 moves downward along the doctor blade 2425, and then moves to the left in FIG. 3 between the developing sleeve 2422 and the mixer 2423 with the rotation of the mixer 2423. Therefore, the developer is likely to remain near the area ARA in FIG. 3. Due to such retention of the developer, the caking of the developer and sticking of the developer to the doctor blade 2425 may occur.

When the MFP 100 is performing an operation for image formation, the processor 2411 in the formation controller 241 executes information processing for a well-known operation for image formation (hereinafter, referred to as formation control processing). Further, the processor 2411 executes information processing for controlling the reverse rotation operation (hereinafter referred to as reverse rotation control processing) in parallel with the formation control processing every time the image formation on one print sheet under the formation control processing is completed.

Figure 5:
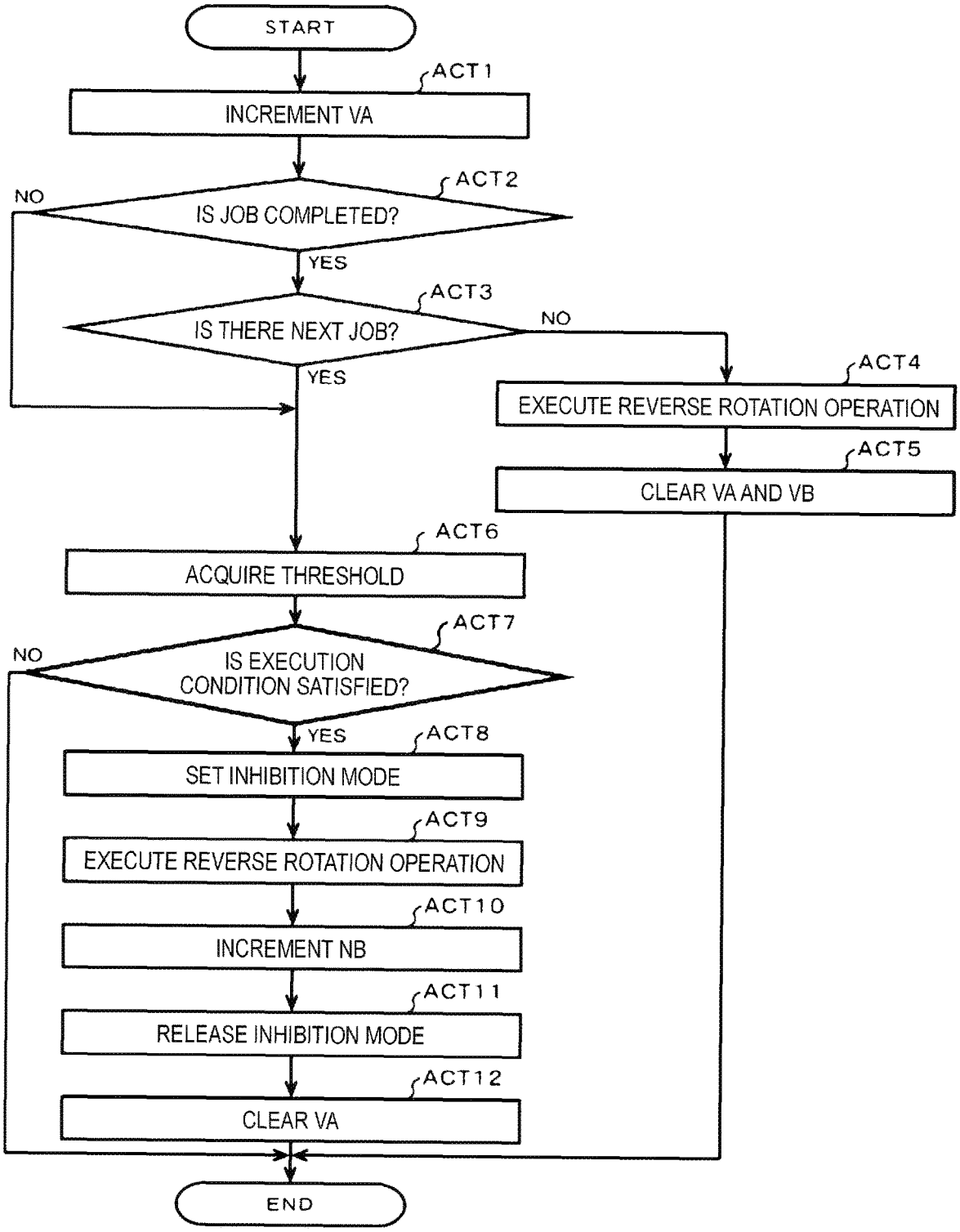
FIG. 5 is a flowchart of reverse rotation control processing.

FIG. 5 is a flowchart of the reverse rotation control processing. The contents of the processes described below are examples and it is possible to change the order of some processes, omit some processes, or add other processes as appropriate.

As ACT 1, the processor 2411 increments a variable VA. The variable VA is the count value of the number of sheets of image formation after the previous reverse rotation operation. That is, the processor 2411 counts up the number of sheets of image formation to reflect the image formation executed immediately before.

As ACT 2, the processor 2411 confirms whether or not the job having been executed is completed by the image formation for one sheet which was completed this time. Then, the processor 2411 determines YES when the job is completed and proceeds to ACT 3.

As ACT 3, the processor 2411 confirms whether or not there is a reserved next job. If there is no corresponding job, the processor 2411 determines NO and proceeds to ACT 4. That is, the processor 2411 advances to ACT 4 when the continuous forming period ends.

As ACT 4, the processor 2411 executes a reverse rotation operation. For example, the processor 2411 drives the rotation mechanism 2426 via the interface unit 2414 to rotate the developing sleeve 2422 and the mixers 2423 and 2424 in a direction DB. The rotation amount of the developing sleeve 2422 and the mixers 2423 and 2424 at this time is a predetermined angle or rotation number. The rotation amount is determined to such a degree that the developer flows in the area ARA to the extent to disperse the developer collected in the area ARA. The rotation amount is appropriately set by, for example, the designer of the MFP 100 based on experiments, simulations, empirical rules, and the like.

As ACT 5, the processor 2411 clears both the variable VA and the variable VB to 0. The variable VB is a count value of the number of times the reverse rotation operation is executed during one continuous forming period. Then, the processor 2411 ends the reverse rotation control processing.

As described above, the processor 2411 executes the reverse rotation operation when the job having been executed is completed without the reservation of the next job, that is, when the continuous forming period is completed. Then, in this case, the processor 2411 clears the variable VA in order to count the number of sheets of image formation after this reverse rotation operation. The processor 2411 also clears the variable VB in order to count the number of times the reverse rotation operation is performed during the next continuous forming period.

If the job is not completed by the image formation of one sheet that was completed this time, the processor 2411 determines NO in ACT 2 and proceeds to ACT 6. Even if the job is completed, the processor 2411 determines YES in ACT 3 and proceeds to ACT 6 if there is a reserved next job. In other words, the processor 2411 advances to ACT 6 when the continuous forming period did not end due to the end of image formation that triggered the start of the reverse rotation control processing this time.

As ACT 6, the processor 2411 acquires a threshold. The processor 2411 acquires, for example, the temperature measured by the temperature sensor 81 via the printer controller 7. Then, the processor 2411 reads out a threshold associated with the temperature zone into which the acquired temperature falls and the number of executions represented by the variable VB in the threshold table TA.

As ACT 7, the processor 2411 confirms whether or not the condition for executing the reverse rotation operation is satisfied. The execution condition is predetermined as a condition that is satisfied when the number of sheets counted by the variable VA exceeds the reference number of sheets defined by the threshold acquired in ACT 6. If the acquired threshold is represented as TH, the execution condition is defined as one of "VA>TH", "VA≥TH", and "VA=TH", for example. Which of these execution conditions is applied is appropriately set by, for example, the designer of the MFP 100. Then, when the execution condition is satisfied, the processor 2411 determines YES and proceeds to ACT 8.

As ACT 8, the processor 2411 sets an inhibition mode. During the setting of the inhibition mode, the processor 2411 inhibits the start of the operation for image formation by the formation control processing.

As ACT 9, the processor 2411 executes the reverse rotation operation similarly to ACT 4.

As ACT 10, the processor 2411 increments the variable NB. That is, the processor 2411 counts up the number of times the reverse rotation operation is executed during the current continuous forming period.

As ACT 11, the processor 2411 releases the inhibition mode. As a result, the processor 2411 starts the operation for the next image formation by the formation control processing.

As ACT 12, the processor 2411 clears the variable VA in order to count the number of sheets of image formation after the current reverse rotation operation. Then, the processor 2411 ends the reverse rotation control processing.

When it is determined to be NO in ACT 7 because the execution condition is not satisfied, the processor 2411 ends the reverse rotation control processing without executing ACT 8 to ACT 12, that is, without executing the reverse rotation operation.

The processor 2411 executes ACT 8 to ACT 12 each time the execution condition is satisfied even during one continuous forming period. That is, the processor 2411 periodically executes the reverse rotation operation after suppressing the normal developing operation during one continuous forming period. That is, the processor 2411 rotates the developing sleeve 2422 and the mixer 2423, which are examples of the rotator, in the direction DB as a second direction opposite to the first direction. Thus, the computer having the processor 2411 as a central part performs a second control to function as the control unit by the processor 2411 executing the information processing based on the information processing program.

Figure 6:
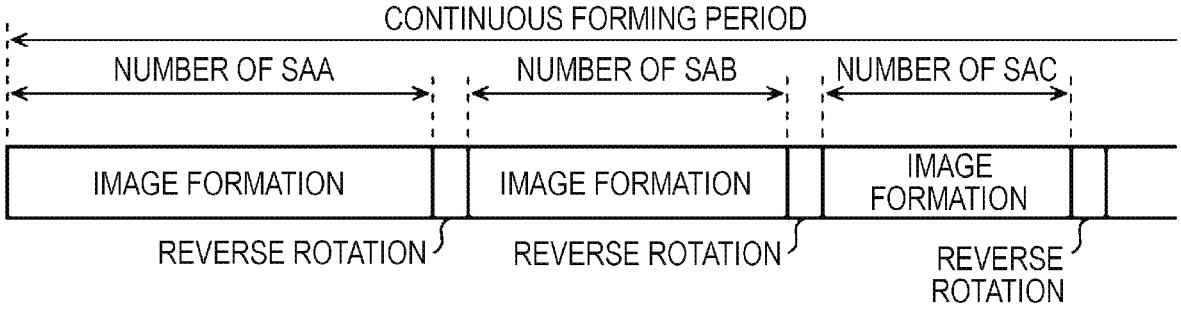
FIG. 6 is a diagram showing execution timings of an image forming operation and a reverse rotation operation during one continuous forming period.

FIG. 6 is a diagram showing execution timings of an image forming operation and a reverse rotation operation during one continuous forming period. FIG. 6 roughly represents the timing relationship and does not accurately represent the ratio of the length of time of each period. For example, the length of the execution period of the reverse rotation operation is exaggerated as compared with the length of the image forming period.

FIG. 6 is an example of a case where the temperature measured by the temperature sensor 81 stops within the temperature zone TZA.

First, the image formation on SAA sheets is continuously executed. Next, the first reverse rotation operation is executed. Subsequently, after the image formation on SAB sheets is continuously executed, the second reverse rotation operation is executed. Further, after the image formation of SAC sheets is continuously executed, the third reverse rotation operation is executed. Since the relationship is defined as SAA>SAB>SAC, the intervals at which each reverse rotation operation is executed are sequentially shortened.

In this way, the processor 2411 gradually reduces the interval between the reverse rotation operations when the reverse rotation operation is periodically executed during one continuous forming period. Thus, the control unit realized by the processor 2411 executing information processing based on the information processing program performs the above control in addition to the above-described first control and second control.

By the reverse rotation operation, the MFP 100 can cause a flow of the developer in the area ARA that disperses the developer collected in the area ARA during image formation. As a result, according to the MFP 100, it is possible to prevent the caking of the developer and sticking of the developer to the doctor blade 2425 in the area ARA.

Also, the MFP 100 sequentially shortens the interval at which each reverse rotation operation is executed as described above. As a result, in a situation where image formation is performed at a high frequency such that the continuous forming period becomes long, caking and sticking can be reliably prevented by executing the reverse rotation operation at a relatively short time interval. Further, in a situation where image formation is performed at a low frequency such that the continuous forming period does not become so long, the productivity can be maintained by performing the reverse rotation operation at a relatively long time interval.

Meanwhile, the developer has the property of being melted by heating to fix the developer on the print sheet. Therefore, the higher the temperature, the more likely caking and sticking will occur. However, in the MFP 100, if the temperature zone into which the temperature measured by the temperature sensor 81 rises to fall changes, the interval at which each reverse rotation operation is executed is further reduced. That is, when the temperature inside the MFP 100 is high and the developer is unlikely to melt in the developing devices 242-1 to 242-4, the reverse rotation operation is performed at a relatively short time interval to reliably prevent caking and sticking. When the temperature inside the MFP 100 is low and the developer is unlikely to melt in the developing devices 242-1 to 242-4, the reverse rotation operation is executed at a relatively long time interval to keep the productivity.

This embodiment can be modified in various ways as follows.

The mixer 2424 may not rotate in the reverse direction. Further, either of the developing sleeve 2422 and the mixer 2423 may be rotated in the reverse direction.

A rotator other than the developing sleeve 2422 and the mixers 2423 and 2424 may be provided in the developing devices 242-1 to 242-4 and the rotator may be rotated in the reverse direction.

When a plurality of rotators that are the targets of reverse rotation are included, the directions of reverse rotation of those rotators do not have to match each other. For example, at the time of image formation, the developing sleeve 2422 may be rotated in the direction DA and the mixers 2423 and 2424 may be rotated in the direction DB, and at the time of reverse rotation, the developing sleeve 2422 may be rotated in the direction DB and the mixers 2423 and 2424 may be rotated in the direction DA. In this case, for the developing sleeve 2422, the direction DA corresponds to the first direction and the direction DB corresponds to the second direction. For the mixers 2423 and 2424, the direction DA corresponds to the second direction and the direction DB corresponds to the first direction.

The image forming apparatus including one to three or five or more developing devices can be implemented in the same manner as the above embodiment.

In the above-mentioned embodiment, the change of the threshold according to the number of executions is made in three stages, but the change may be made in two stages or four stages or more. However, a smaller threshold is associated as the number of executions increases.

In the above embodiment, three temperature zones TZA, TZB, and TZC are set. However, two, or four or more temperature zones may be set. However, as the temperature becomes higher, a smaller threshold is associated for the same number of executions.

The threshold may be set in association with the number of executions without considering the temperature.

Generally, the MFP has a function of counting the total number of sheets of executed image formation. Therefore, the processor 2411 may determine the number of sheets of image formation after the reverse rotation operation by using the count value obtained by such a function. For example, the processor 2411 stores the total number of sheets after the reverse rotation operation in the main memory 2412 or the sub memory 2413. Then, the processor 2411 may obtain the number of sheets of image formation after the reverse rotation operation by subtracting the count value thus stored from the latest count value.

The processor 2411 may execute the formation control processing and the reverse rotation control processing as integrated information processing based on a single information processing program.

The processor 2411 may acquire the threshold by another method such as a calculation based on a predetermined mathematical expression.

The structure of the developing sleeve 2422 can be modified in various ways as long as the developing sleeve has a function of conveying the developer attached to the circumferential surface to the outside of the housing 2421.

The structure of the mixer 2423 can be modified in various ways as long as the mixer has a function of supplying the developer to the circumferential surface of the developing sleeve 2422.

The structure of the mixer 2424 can be modified in various ways as long as the mixer has a function of sending the developer from the section SEB to the section SEA.

Some or all of the functions realized by the processor 2411 by information processing can be realized by hardware that executes information processing that is not based on a program, such as a logic circuit. Further, each of the above-mentioned respective functions can be realized by combining hardware such as the above logic circuit with software control.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing device that includes a rotator for rotating to cause a developer contained in a container to flow, the developing device configured to perform development using the developer; and a controller comprising a first control for rotating the rotator in a first direction during development, and a second control for rotating the rotator in a second direction opposite to the first direction at a predetermined timing when development is not performed, and the controller gradually decreases an interval at which the second control is performed when the second control is performed a plurality of times during a predetermined period.

2. The image forming apparatus according to claim 1, wherein the predetermined timing occurs after the first control is executed for a predetermined number of sheets.

3. The image forming apparatus according to claim 1, wherein the predetermined period is a period during which the first control is continuously executed.

4. The image forming apparatus according to claim 1, wherein the rotator comprises a developing sleeve that conveys the developer attached to a circumferential surface to an outside of the container.

5. The image forming apparatus according to claim 1, wherein the developing device comprises a developing sleeve that conveys the developer attached to the circumferential surface to the outside of the container, and the rotator comprises a mixer that supplies the developer to the circumferential surface of the developing sleeve.

6. The image forming apparatus according to claim 1, wherein the rotator comprises a developing sleeve that conveys the developer attached to the circumferential surface to the outside of the container, and a mixer that supplies the developer to the circumferential surface of the developing sleeve.

7. The image forming apparatus according to claim 1, further comprising:

a temperature sensor for detecting a temperature in the image forming apparatus, wherein the controller further changes the interval according to the temperature detected by the temperature sensor.

8. The image forming apparatus according to claim 7, wherein when the temperature falls into a first temperature zone, the controller reduces the interval when the temperature falls into a second temperature zone different from the first temperature zone and increases the interval when the temperature falls into a third temperature zone different from the first temperature zone.

9. The image forming apparatus according to claim 8, wherein the second temperature zone is higher than the first temperature zone, and the third temperature zone is higher than the first temperature zone.

10. A control method of an image forming apparatus including a developing device comprising a rotator rotating to cause a developer contained in a container to flow and performs development using the developer, the method comprising:

rotating the rotator in a predetermined direction during development;

periodically rotating the rotator in an opposite direction to that the predetermined direction during development without starting a next development when the development of one sheet is completed, during a period when the next development needs to be started during the development of one sheet; and gradually reducing an interval of reverse rotations when the reverse rotation of the rotator is performed a plurality of times during the period.

11. The method according to claim 10, wherein the predetermined timing occurs after rotating the rotator in a predetermined direction for a predetermined number of sheets.

12. The method according to claim 10, wherein the predetermined period is a period during which rotating the rotator in a predetermined direction is continuously executed.

13. The method according to claim 10, further comprising:

conveying the developer attached to a circumferential surface to an outside of the container.

14. The method according to claim 10, further comprising:

conveying the developer attached to a circumferential surface to the outside of the container; and supplying the developer to the circumferential surface of a developing sleeve.

15. The method according to claim 10, further comprising:

conveying the developer attached to a circumferential surface to an outside of the container, and supplying the developer to the circumferential surface of the developing sleeve.

16. The method according to claim 10, further comprising:

detecting a temperature in the image forming apparatus; and changing the interval according to the temperature detected.

17. The method according to claim 16, further comprising:

when the temperature falls into a first temperature zone, reducing the interval when the temperature falls into a second temperature zone different from the first temperature zone and increasing the interval when the temperature falls into a third temperature zone different from the first temperature zone.

18. The method according to claim 17, wherein the second temperature zone is higher than the first temperature zone, and the third temperature zone is higher than the first temperature zone.

19. A developing system for an image forming apparatus, comprising:

a developing device that includes a rotator for rotating to cause a developer contained in a container to flow, the developing device configured to perform development using the developer; and a controller comprising a first control for rotating the rotator in a first direction during development, and a second control for rotating the rotator in a second direction opposite to the first direction at a predetermined timing when development is not performed, and the controller gradually decreases an interval at which the second control is performed when the second control is performed a plurality of times during a predetermined period.

20. The developing system according to claim 19, wherein the rotator comprises a developing sleeve that conveys the developer attached to a circumferential surface to an outside of the container.

* * * * *